United States Patent [19]

Dordi et al.

[11] Patent Number: 4,821,656

[45] Date of Patent: Apr. 18, 1989

[54] APPARATUS FOR THE SEMIAUTOMATIC FORMATION OF SHEATHS THAT IS, COVERS FOR MATTRESSES AND THE LIKE

[75] Inventors: GianMaria Dordi, Frosinone; Gianfranco Fiorini, Latina, both of Italy

[73] Assignee: Permaflex, S.p.A., Italy

[21] Appl. No.: 76,539

[22] Filed: Jul. 22, 1987

[30] Foreign Application Priority Data

Jul. 24, 1986 [IT] Italy ..... 9446 A/86

[51] Int. Cl.[4] ..... D05B 11/00

[52] U.S. Cl. ..... 112/2.1; 112/10; 112/121.15; 112/304

[58] Field of Search ..... 112/2.1, 2.2, 2, 10, 112/121.15, 304

[56] References Cited

U.S. PATENT DOCUMENTS

| | | | |
|---|---|---|---|
| 3,124,256 | 3/1964 | Schwarzberger | 112/2.1 |
| 3,310,207 | 3/1967 | Gore | 112/10 X |
| 3,339,506 | 9/1967 | McGregor | 112/10 |
| 3,375,796 | 2/1968 | Greenberg et al. | 112/10 X |
| 3,837,305 | 9/1974 | Cash | 112/2.1 |
| 4,067,269 | 1/1978 | Fanghanel | 112/2.1 |
| 4,155,317 | 5/1979 | Enomoto | 112/2.1 |

*Primary Examiner*—H. Hampton Hunter

*Attorney, Agent, or Firm*—McGlew & Tuttle

[57] ABSTRACT

With the carcass of a mattress or with the aid of a template and the use of beaders, the cover or sheath is formed with transit and dwelles; on at least a loading bench; in at least a first beader, in order to bead a perimetral valance to a sheath bottom; in at least an overturning device; in at least a second beader; on at least a bench for the unloading and possible withdrawal of template.

9 Claims, 8 Drawing Sheets

APPARATUS FOR THE SEMIAUTOMATIC FORMATION OF SHEATHS THAT IS, COVERS FOR MATTRESSES AND THE LIKE

DESCRIPTION

The invention relates to an apparatus for the semiautomatic formation of sheaths, that is, covers for mattresses (or the like) direct on the mattresse or, possibly, with the aid of a template, and through the use of beaders or hemming machines.

The apparatus substantially comprises in combination: at least a loading bench; at least a first beader or hemming machine, for beading a perimetral valance to a sheath bottom; at least a bench for the unloading and possibly withdrawal of a template. When templates are used means are also provided in order to cyclically circulate a plurality of templates along a path crossing the above members.

Each beader is practically surrounded by a passageway for the operator, and arms are provided, that can be lifted and lowered, for the passage between said beader and the devices adjacent thereto, said arms having continuous transfer members; said arms may be carried by members located adjacent to the beader.

The overturning device may comprise a pair of symmetrical overturning members, which can be simultaneously lifted, one intended to lift the carcass or template laid on edge, with the cover being partially formed with a first front and the perimetral valance, and the other intended to receive the vertically arranged mattress (carcass) or the template and lower it again in overturned attitude, in order to receive a second cover front and be fed to the second beader.

The invention will be better understood by following the description and the attached drawing, which shows only a practical non limitative exemplification of same invention. In the drawing.

Figure 1:
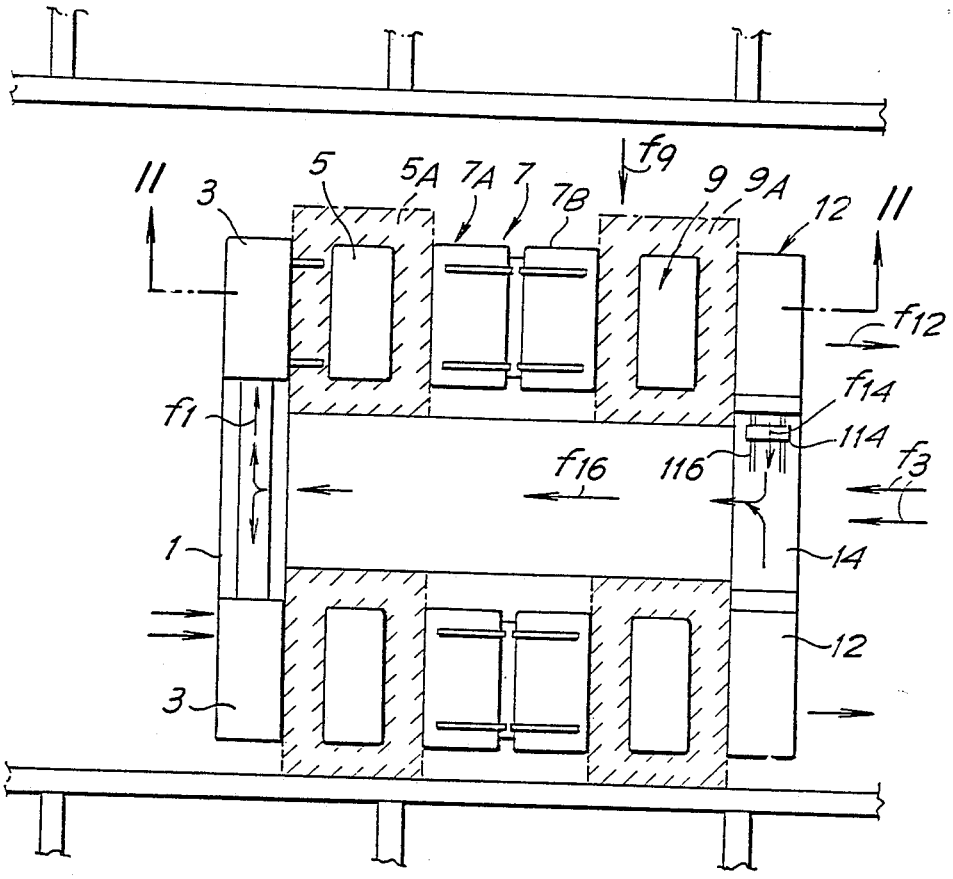
FIG. 1 shows a schematic plan view of an apparatus or "island" for the sheaths formation.

According to what is illustrated in the schematic plan view of FIG. 1, numeral 1 indicates a delivery or sorting group which is intended to deliver the templates having the shape of the mattress outline—and on which templates the extractable cover must be formed—towards one or the other of two first loading benches indicated by 3 and making part of two lines, an upper line and a lower line looking at the drawing, which operate in parallel. Adjacent to the first loading bench 3 on each line, a first beader 5 is located, which is surrounded by a passageway 5A to allow for the transit of the operator who has to follow the sewing machine of said first beader; an overturning device 7 follows, which is, in turn, followed by a second beader 9 with a path 9A that surrounds said beader for the passing of the operator, and a bench indicated by 12 for the unloading and the withdrawal of the template; in common with the two parallel lines, besides the delivery or sorting group 1, there is also a bench for the withdrawal of the template and for the preparation, indicated by 14, and located adjacent to the two unloading benches 12. The templates recovered by the withdrawal bench are transformed along a trajectory indicated by the arrow f16 into an intermediate position between the two mounting lines to reach the delivery or sorting group 1. The overturning device 7 is combined with an unloading bench 7A and with a loading bench 7B, to receive the template with the article being formed from beader 5, and unload it onto beader 9 after having overturned the template with the article respectively. These benches 7A and 7B are similar to that indicated by 3 and to that indicated by 12, in order to feed the template to beader 5 and to receive the template from beader 9 respectively.

A template reaching the delivery group 1 is transferred to one or the other loading bench 3, depending on the program, being already provided—on the preparation bench 14—with an annular band intended to form the side of the cover and one of the two main fronts of the cover which is laid onto the template. The template being so provided with the two components of the cover is fed to the corresponding beader 5 on which the beading is formed between the front carried by the template and the band. The thus formed assembly is transferred onto the overturning device 7 to be overturned thereby, so that the already sewn cover front will be located beneath the template. The operator in charge of the beader 9 receives the template so oriented and transferred to the beader 9 from the bench 7B and, supplies it with the second cover front and provides for the sewing of this second front to the perimetral band or stripe. The template, with the completed and still one end-opened cover, reaches the bench 12 for the unloading and withdrawal of the template, which bench provides for slipping off the template from the cover, according to arrow f14, by transferring it onto the bench 14 and delivering it to the path indicated by f16 while the cover is moved away. Substantially, along each line, the template is fed according to f1 and already supplied with the cover front and band being fed according to f3 onto the preparing bench 14; the second cover is unloaded according to f12, while the template moves along the trajectory f14 and f16 to reach again the delivery group 1 to be fed to one or the other of benches 3. On each line, only the two operators in charge of beaders 5 and 9 are present, unless these beaders are automated.

The individual operating groups will now be described in more details.

Figure 2:
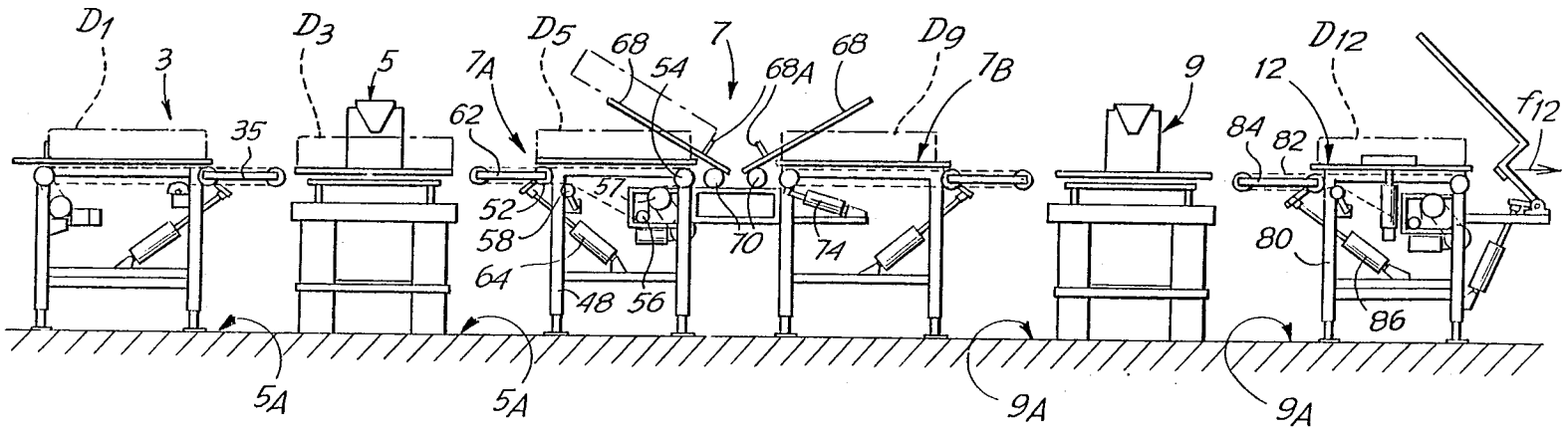
FIG. 2 shows a schematic section substantially taken on line II—II of FIG. 1.
Figure 3:
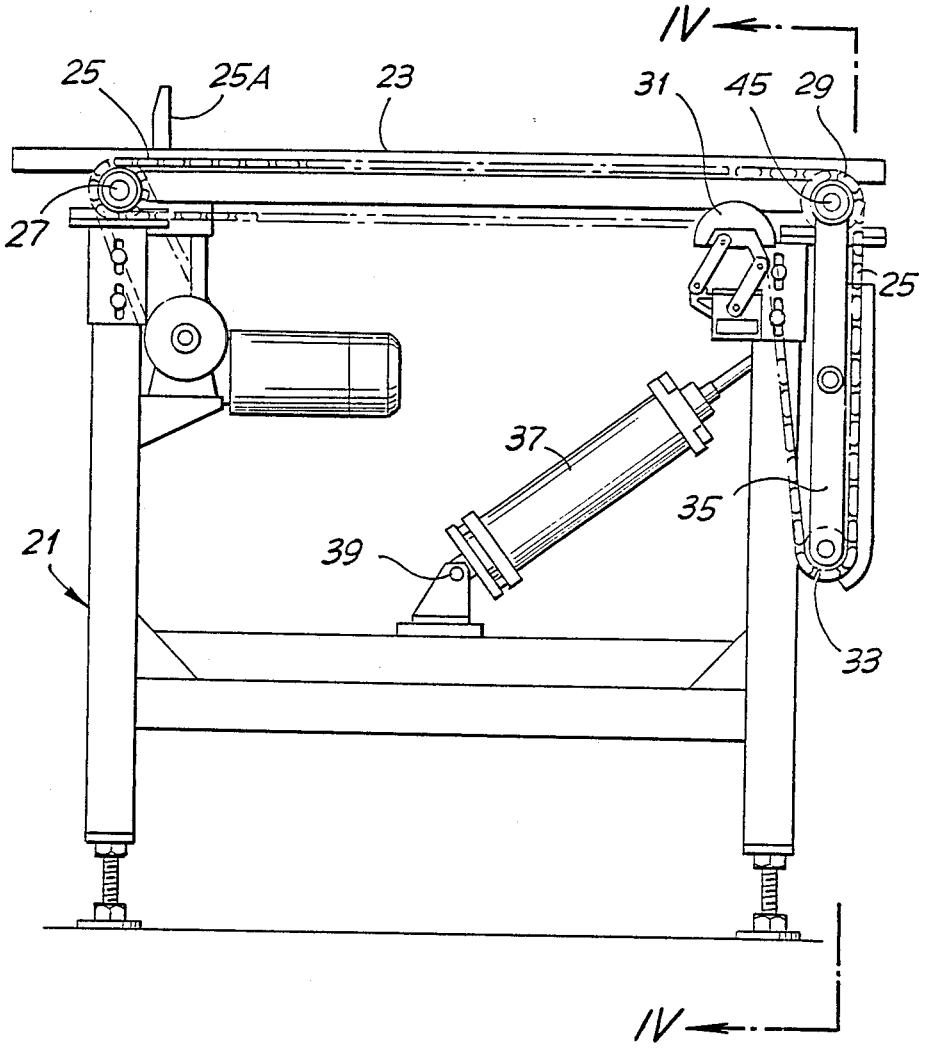
FIGS. 3 and 4 show two views of a loading bench.
Figure 4:
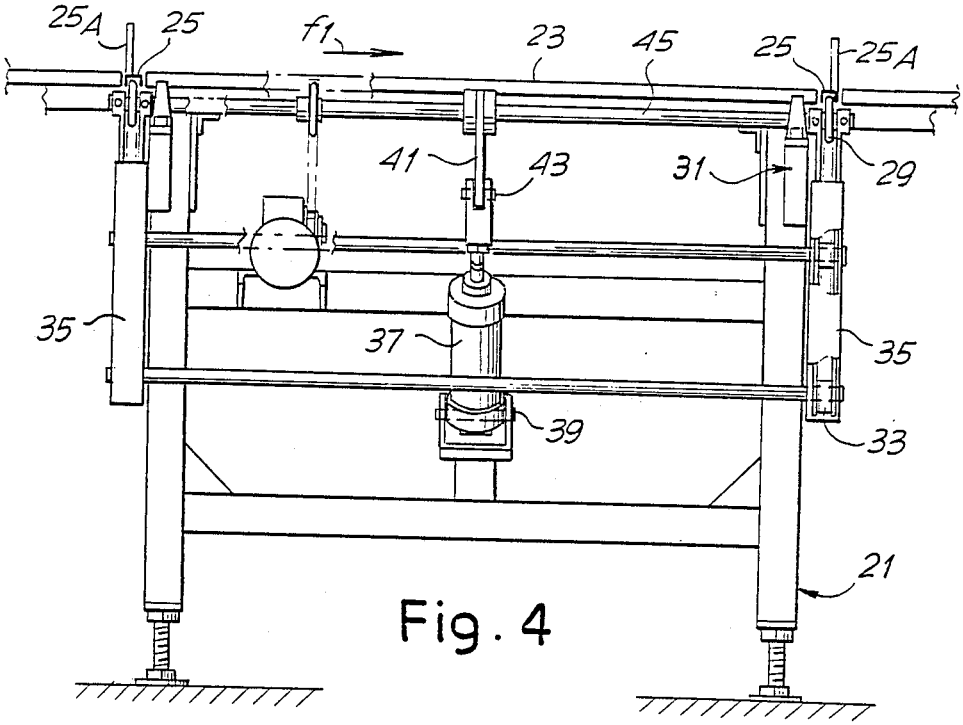

A loading bench like that indicated by 3 (and, in equivalent manner, the other above mentioned) is roughly illustrated in FIGS. 1 and 2 and in more details in FIGS. 3 and 4. A loading bench comprises a housing 21 with an upper surface 23 for the sliding of the template. On this surface, a template is pushed according to arrow f1 until it reaches the position in alignment with the line of the beader 5, the overturing device 7 and the beader 9. Transversally to the direction of an incoming template D1, indicated by the arrow f1, at least a pair of belt or continuous chain conveyors 25 are provided which are driven by transmission wheels 27, 29 and by a chain stretcher 31 carried by the housing 21, as well as by a transmission wheel 33 supported at the end of a mobile arm 35 corresponding to each conveyor 25, each arm 35 being articulated on the axis of the transmission wheels 29. The arms 35 are simultaneously driven so as to be raised from the position illustrated in FIGS. 3 and 4 as far as to a horizontal arrangement at the level of the branches just below the plane 23, for this manoeuvre, a central jack 37 is provided, articulated to the housing 21 at 39 and to an arm 41 at 43, the arm 41 being solid to a shaft 45 on which the arms 35 are blocked and the transmission wheels 29 are mounted. The chains or other flexible means 25 carry pushrods 25A able to act on the side of the template to move it orthogonally in respect to the arrow f1 from the bench 23 up onto the first beader 5, when the arms 35 are lifted as indicated in FIG. 2, in order to provide, temporarily, a surface continuity for the transfer of the template above the operator's passage zone 5A to the beader 5; pushrods 25A act along the horizontal length of bench 23 and of lifted arms 35 and can be made to come back by a reverse motion of conveyors 25 or a continuation of the path along a return trajectory without any reversal of motion. Immediately after the transit of a template (supplied with the side band and a front) from the loading bench 3 to first beader 5, arms 35 are lowered again in the arrangement of FIG. 3, to allow the operator to freely move about beader 5.

Beader 5 performs the first sewing of the edge between the cover perimetral band and the cover front which is loaded on the loading bench 14, as indicated by f3.

A beader to be placed at the position 5 may be the one illustrated in another contemporary patent of the same applicant.

Figure 5:
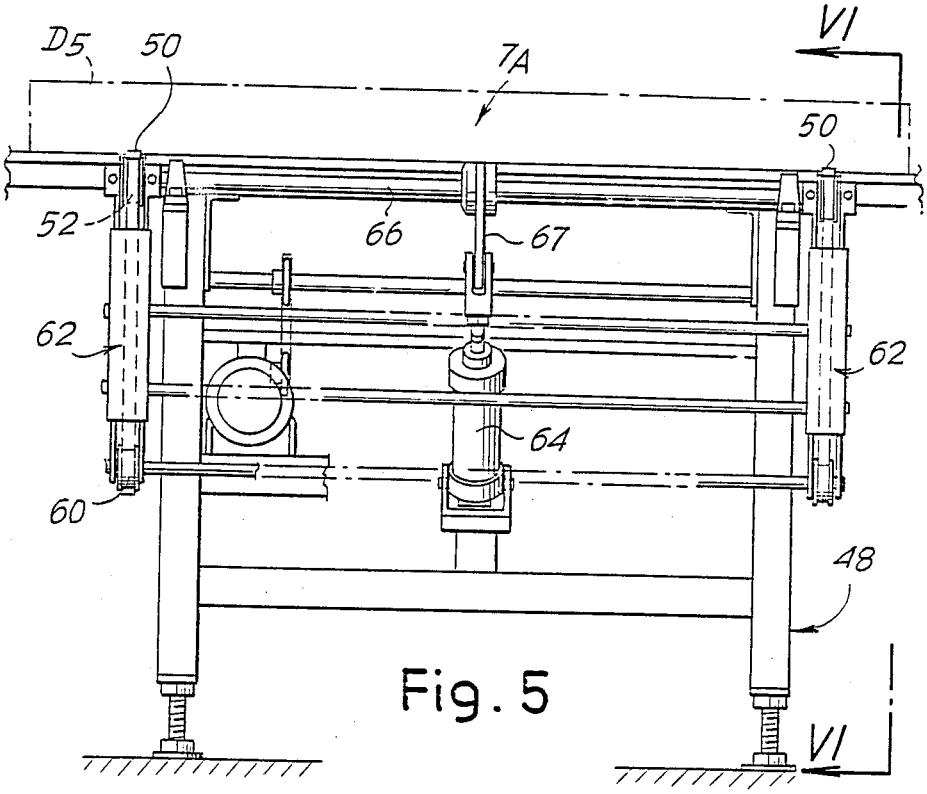
FIGS. 5 and 6 show, in two views, an unloading bench.
Figure 6:
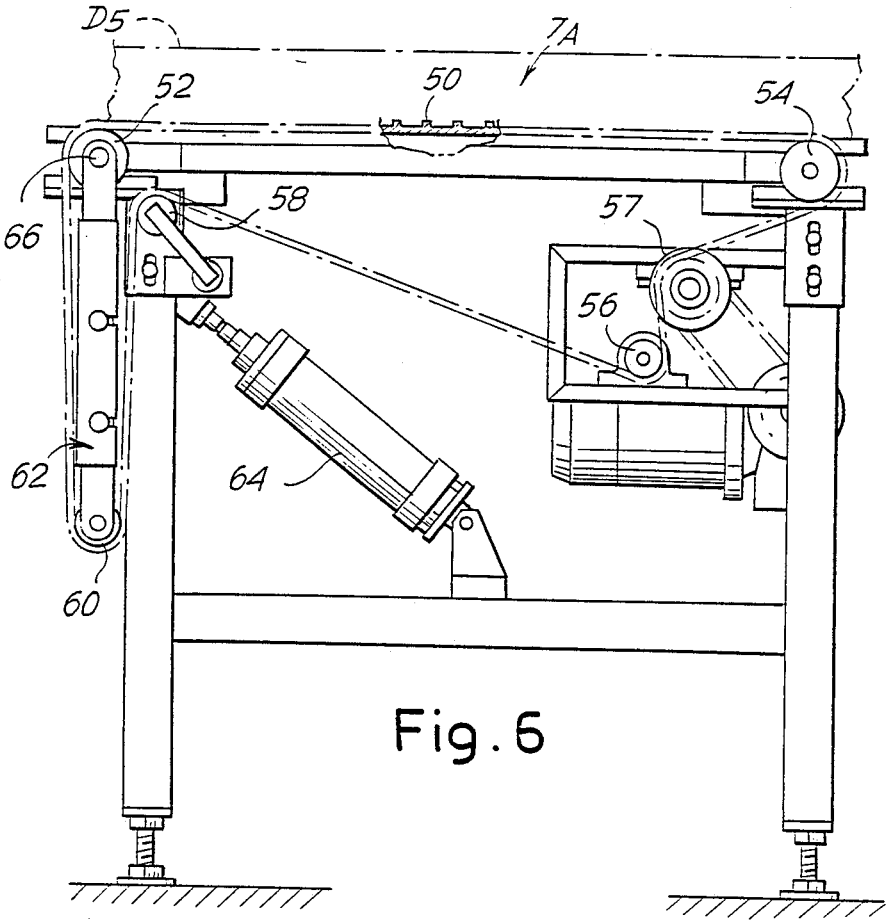

Roughly in FIG. 2 and, in more detail, in FIGS. 5 and 6, one of the loading and unloading benches 7A and 7B associated with the template-overturning group is shown. A bench like that indicated by 7A comprises a housing 48 similar to that indicted by 21 and associated to the housing of the overturning group; on the housing 48, transmission wheels are provided for two continuous conveyor groups represented by belts or chains 50 which are driven between fixed transmission wheels 52, 54, 56, a driving wheel ;57, a chain-stretcher transmission wheel 58 and a transmission wheel 60 mounted on the end of a respective arm 62 articulated on the axis 66 of wheels 52, in order to obtain an arrangement similar to that concerning the arms 35. The arms 62 are driven through a pneumatic cylinder 64, similar to that indicated by 37, connected to the axis 66 through a lever 67. Through the lifting of arms 62 an unloading bench 7A allows the transit of the template along with the cover or sheath under formation from beader 5 to the overturning group 7, by moving the template from the position D3 on the beader 5 to the position D5 on the housing 48. An arrangement similar to that just described is provided for the bench 7B which has to transfer (similarly to the loading bench 3) the template from the loading bench 7B to the second beader 9.

Figure 7:
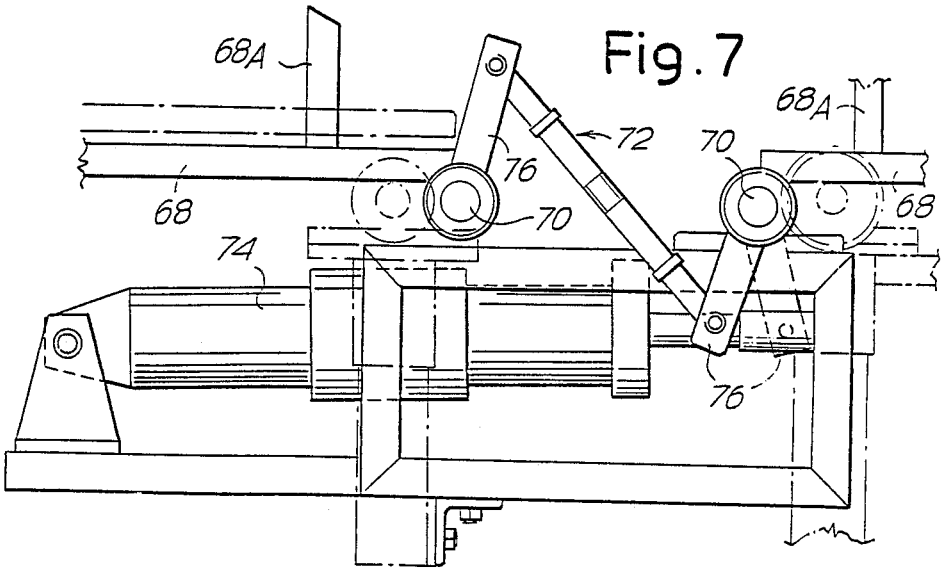
FIG. 7 shows schematically a group for the overturning of the mattress.

The overturning group 7 is intended to overturn a template from the position D5 to the position D9 of FIG. 2 by overturning it, that is, by bringing the sheath front, sewn to the perimetral band, under the template which thus reaches position D9. To carry out this (see FIGS. 2 and 7), two pairs of following arms 68 are provided being symmetrical to each other and articulated on two parallel exes 70, which are connected between them through a "Z"-shaped articulation 72 apt to be driven by a jack 74 which moves the crank 76 of one of the axes 70 and, consequently, the crank 76 of the other axis, both these cranks making part of the articulation 72. In this way, the two shafts 70, and thus the two pairs of arms 68, perform angular displacements between a horizontal position wherein the arms 68 are below the support plane on which they graze the conveyors 50 and a lifted position, through a rotation of approximately 95° of the arm 68 together with the template in respect to the plane of the bench 7A, in order to favour the changing over of the template between the two arms 68; the two arms are brought parallel between them and closer to each other as far as a distance in the range of the template thickness. The arms 68 include supports 68A which serve for supporting the template when this is transferred by arms 68, which take it away from position D5 to discharge it onto the adjacent arms 68; the second pair of arms 68, upon the reverse and symmetrical motion, lay the template in the position D9 above the transfer plane of the loading bench 7B. Substantially, the overturning group 7 transfers the template from position D5 to position D9 so as to allow the transfer from the loading bench 7B to the second beader D9, according to the already described arrangement and manner for the template transit from position D1 to position D3 between the loading bench 3 and the beader 5.

The group 12, similarly to the unloading bench 7A, comprises a housing 80 which supports a pair of conveyors 82 analogous to those indicated by 50 of the bench 7A, developing likewise the latter on the arms 84 which can be lifted and lowered to transfer the template together with the cover or sheath from the beader 9 to position D12 on said group 12. The arms 84 are intended to ensure the continuity of the transfer surface into the transit zone 9A around the beader 9 provided for the operator; the arms 84 can be driven by a jack 86 likewise the above described arrangements.

The template, overturned by the overturning group 7, has been completed with a second sheath front by the operator in charge of the beader 9 and then completed by the sewing of said second front to the band already sewn to the first sheath front; accordingly, the template with the sheath coming from beader 9, and which reaches the position D12 on the bench 12, carries, along with, it the sheath or cover being completed and open along one end thereof to allow the withdrawal of the template and the subsequent insertion of the spring assembly of the mattress. The opening may include a so-called "zipper" fastener, or another suitable closure means already arranged on the band, or a partial unsewn zone of the cover may be provided. the open zone for the withdrawal of the template is to be provided at the end of the cover or sheath which is adjacent to the withdrawal bench 14 for the withdrawal of the template according to arrow f14 of FIG. 1.

Figure 11:
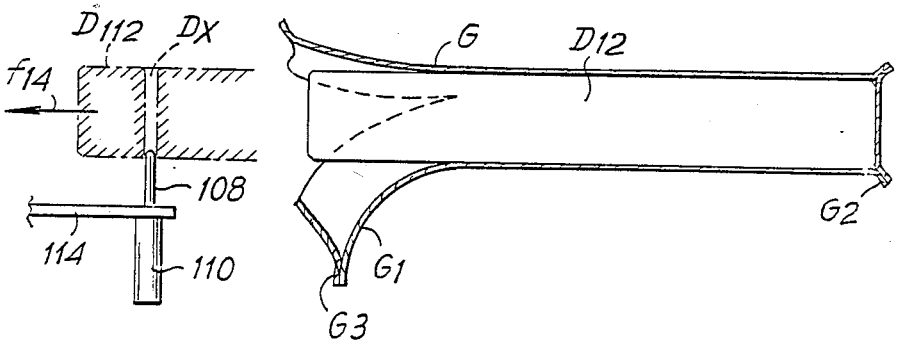
FIG. 11 shows a functional scheme of the bench of FIGS. 8, 9 and 10.

The group 12 makes up, together with the housing 80, a resting surface for the template at position D12, where the same template can be positioned, besides according to the transverse direction resulting from its transfer by systems 82, also in orthogonal direction, that is, in the direction of arrow f14, to ensure the hold positioning of the template and the retention of the cover, thereby retaining the cover as well as opening the mouthpiece thereof and allowing the template withdrawal. The operation to be carried out is indicated in particular in FIG. 11, wherein the template at position D12 is shown which is to be withdrawn according to arrow f14 from the sheath G whose mouthpiece must be opened by the lowering of the lower part G1 of the cover in correspondence to the end at which said mouthpiece is formed. Accordingly, a longitudinal positioning of the template is to be assured in the direction of the arrow f14, so that a hold of the sheath G is possible in correspondence to the edge G2 to prevent it from being dragged along by the template withdrawn in the direction of f14, and of the edge G3 to ensure the opening of the mouthpiece, that is, the lowering of the part G1 of the cover, in order to allow the template withdrawal. Moreover, the template positioning has to be also ensured so that this can be engaged by a trailing peg within a seat DX formed by the same template; preferably, the seat DX is provided with through type to be present in correspondence of both the main fronts of the template and also in correspondence to, that is, in the vicinity of both the minor sides in order to ensure the operation regardless of the arrangement according to which the template might reach the position D12.

The template arriving at position D12 from beader 9 must be positioned, first of all, in such a way as to ensure the hold of the edge G3 of the part G1 which is to be opened. To this aim, a cylinder-piston system 90 is provided, able to push, within certain limits, the template with the sheath into position D12 according to arrow f14 as far as to bring the same template in abutment against a transverse pawl 92 stemming from a crosspiece 94. This crosspiece makes part of an articulated parallelogram system which can be lowered and comprises arms 96 articulated to the housing 80; the articulated system 96, 94 can be driven by a jack 100 which can lower the crosspiece 94 and the pawl 92. To the parallelogram system 96, 94, two jacks 98 are associated which are intended to drive a mobile unit 102 which, in particular, carries a pair of pliers (or gripping means) 102A capable of being lowered onto the crosspiece 94 when the jacks 98 lengthen. By the cylinder-piston system 90 it is thus possible to move the template and the sheath into abutment onto the pawl 92 which is able to position the edge G3 with accuracy on the crosspiece 94 and afterwards, by the action of jacks 98, to ensure the engagement of the edge G3 to crosspiece 94. Soon after,the jack 100 can be driven to deform the articulated parallelogram system and thus lower the crosspiece 94 which by pliers 102A drags downwards, also the edge G3, thereby causing the opening of the mouthpiece formed by the sheath G to allow the template withdrawal. A cylinder-piston system 106 is able to urge, through its own pusher 106A, the template located at position D12, together with the sheath formed thereon, as far as to reach the well defined position D112, so as to bring the template and the sheath mounted thereon into position D112 in which a seat DX, for the engagement of the template, finds itself in correspondence to a hold stem 108 which is at a position spaced, by a limited extent, from the assembly of pawl 92 and pliers 102A. The hold stem 108 can be vertically driven by a cylinder-piston system 110 carried by a carriage 114 which slides on guides 116 developing along the bench for the template-withdrawal and for the preparation indicated by 14 in FIG. 1. The template displacement by system 106, 106A is allowed after the lowering of the pliers or gripping means, represented by the crosspiece 94 and the members 102A, which open the mouthpiece of the sheath or cover. Upon the displacement operated by system 106, the template end, which is opposite to the one brought into position on the stem 108, is caused to locate itself along a crosspiece 118 carried by the housing 80 and with which a pair of "hands" 120, articulated at 122 and driven by a cylinder-piston system 124, are able to cooperate. The actuation of the cylinder-piston system 124 causes the rotation of shaft 122 and thus causes the hands 120 to move above the support surface of the template after the latter has moved forward into position D112, in such a way as these hands 120 engage the edge G2 of the sheath after the displacement operated by system 106 for an accurate positioning of the edge G2 on the crosspiece 118. When the position D112 is reached it follows that: the sheath mouthpiece opens because of the lowering of part G1 and deformation of said part G1 retained with its edge G3 by pliers 94, 102A; anf the template moves with its uncovered end as far as to have the seat DX positioned on the stem 108 and the edge G2 of the sheath engaged to the end opposite to that of the open mouthpiece.

Figure 8:
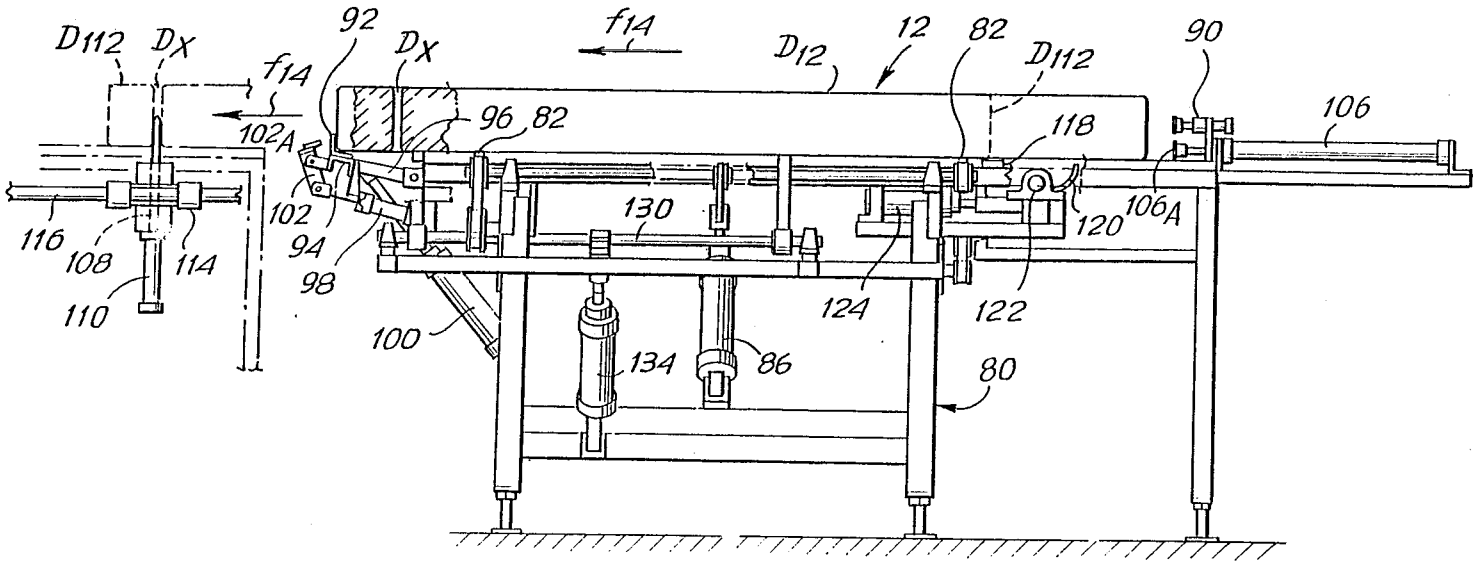
FIGS. 8, 9 and 10, show a side view, a plan view and an enlarged end view of a bench for the unloading and withdrawal of the template for the separation from the sheath.
Figure 9:
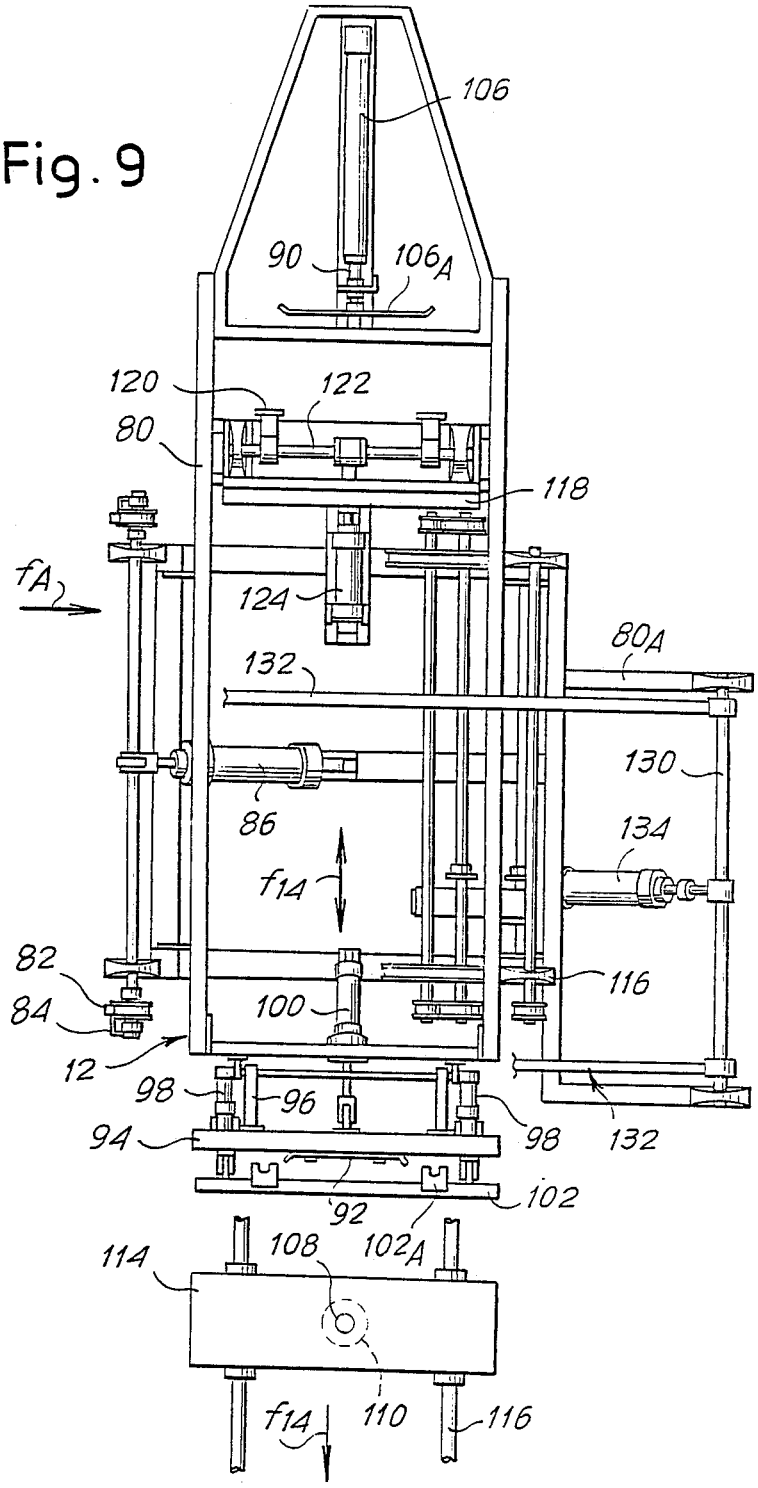
Figure 10:
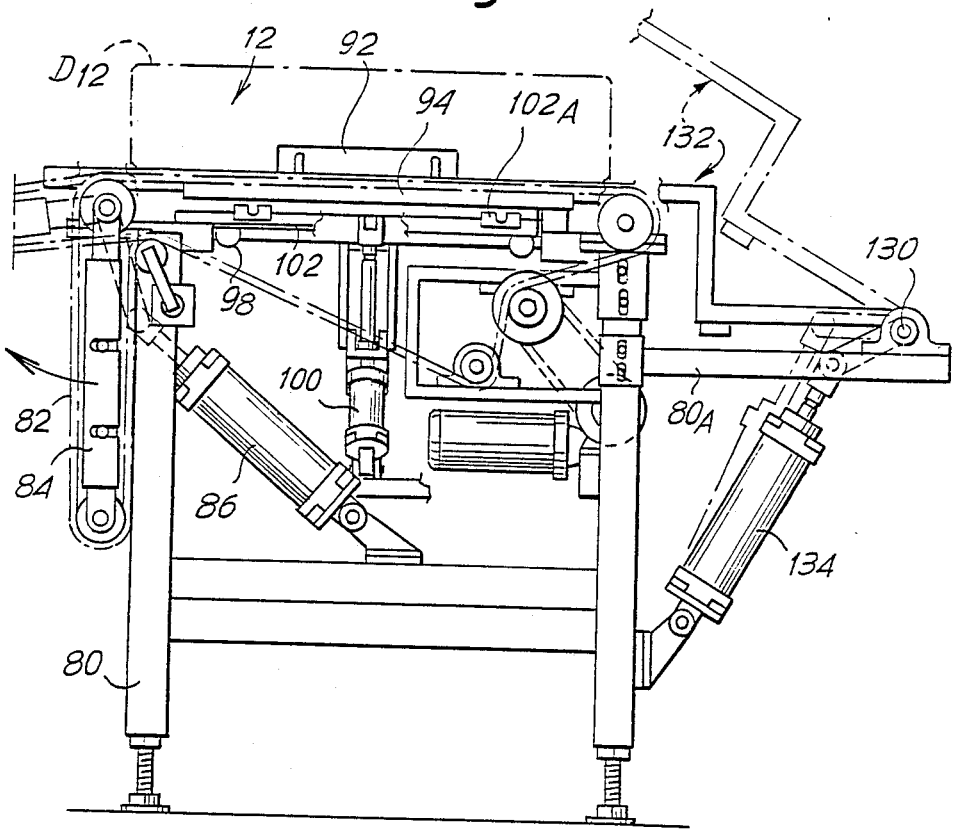

As soon as the template and the sheath have reached the position D112, the stem 108 is lifted by system 110 in order to engage the template through its penetration into the seat DX, and after that the carriage 114—by means of a system not shown but of simple construction—is moved according to arrow f14 to bring the template onto the withdrawal and preparing bench indicated by 14, while withdrawing the template from the sheath having the edge G2 held by the gripping means formed by hands 120 and crosspiece 118. The displacement of the template is ensured by the defilade of the pawl 92 which is made to lower together with the gripping means which have seized the edge G3. The withdrawal of the template allows the sheath to be left on the support surface formed by the housing 80, from which said sheath is moved away according to arrow f12. Once the sheath has been retained through the withdrawal of the template therefrom, the same sheath is released by hands 120 and pliers 102A and can thus be transferred in any suitable manner. In the drawing (see in particular FIGS. 8 to 10) a withdrawal overturning system is provided, an articulation 130, for a unit 132 comprising at least two arms, being provided on a bracket 80A of the housing 80, said arms extending along the whole support surface for the template and sheath and being able to be lifted about the articulation 130 by a jack 134, which causes same arms to be overturned, thereby determining the withdrawal of the sheath or cover that is thus moved away according to arrow f12.

The template moved by the carriage 114, according to arrow f14, is released by the stem 108 which is defiladed by the system 110 to come back into position for the gripping of a new template; the so released template can be transferred according to arrow f16 up to reach again the delivery system 1 so as to be fed to one or the other of the loading benches 3 and start a new operation.

The apparatus in question allows the working of the sheaths or covers of the mattresses or other equivalent articles to be performed by a minimum labour intervention and maximum practicality and economy.

The system described in the preceding pages relates to the manufacturing of sheaths by a suitable template; the invention may also be accomplished by utilizing the same carcass as a template, and the sewing operation, performed by beader 9, is completely carried out as it previously occurs at beader 5. In this way, the completely finished mattress is obtained, without having to resort to the previously described system for the withdrawal of the template, thereby avoiding the operations of the bench 12 and the subsequent insertion of the springs assembly into the cover.

It is understood that the drawing shows an exemplification given only as a practical demonstration of the invention, as this may vary in the forms and dispositions without nevertheless departing from the scope of the idea on which the same invention is based.

We claim:

1. An apparatus for the semi-automatic manufacture of sheath-form covers for mattresses including a first series of work stations arranged sequentially to provide a first workpiece feed path having workpiece entry and exit ends comprising:

a first loading bench at the entry end for receiving a mattress template and the workpiece, comprising an annular band for the formation of the side of the cover and one of two main fronts of the cover;

a first beader adjacent said loading bench, for beading said annular band to said one main front of the cover along perimetrical edges thereof;

first transfer means operable to extend between the first loading bench and the first beader for transferring said template from said loading bench to said first beader;

a first unloading bench and a second loading bench adjacent the first unloading bench;

an overturning device connected between said first unloading bench and said second loading bench, said overturning device having two sets of arms operable to engage respective opposite sides of the template and to remove the template from said first unloading bench overturn and deposit the template in overturned condition on said second loading bench;

second transfer means operable to extend between the first beader and the first unloading bench for transferring said template from said first beader to said first unloading bench;

a second beader adjacent said second loading bench;

third transfer means operable to extend between the second loading bench and the second beader for transferring said template from said second loading bench to said second beader;

a second unloading bench at the exit end of the feed path including means for withdrawing the template from the cover formed thereon; and, fourth transfer means operable to extend between the second unloading bench and the second beader for transferring said template from said second beader to said second unloading bench.

2. Apparatus according to claim 1 wherein each beader is surrounded by a passageway for an operator and wherein said first, second and third transfer means each comprises conveyor belt means entrained over pulleys, conveyor belt actuating means including supporting arms operably connected to said pulleys to move said transfer means between operative, raised, positions in which they extend cantilever fashion across the passageway and non-operative lowered, positions in which the conveyor belt means are clear of the passageways thereby to permit operator access between the benches and the beader.

3. Apparatus according to claim 2 wherein said first, second, third and fourth supporting arms are mounted on said first loading bench, said first unloading bench, said second loading bench and said second unloading bench, respectively.

4. Apparatus according to claim 1 further comprising a template receiving bench arranged to receive a template from which a cover manufactured thereon has been removed from the second unloading bench for subsequent transfer of the template back to said first loading bench.

5. Apparatus according to claim 1 wherein second unloading bench comprises:

means for centering a template on the cover formed thereon;

a cover gripping means operable to releasably grip and open the cover to enable removal of the template therefrom;

a template removal stem, means to move said stem into an out from engagement with the template;

means arranged to move said stem laterally when in engagement with said template thereby to withdraw said template from said cover;

and, means for retaining said cover during withdrawal of said template therefrom.

6. Apparatus according to claim 1 comprising a second series of sequentially arranged work stations similar to the first series and defining a second workpiece feed path extending parallel to the first workpiece feed path and a template sorting means disposed between both first loading benches at the respective entry ends of the feed path to deliver templates to either first loading benches.

7. Apparatus according to claim 6 comprising template removing means mounted between respective entry ends of the feed path; a return station adjacent respective entry ends of the feed path; guides extending from both second unloading benches to the return station; a template conveying carriage mounted for movement alond the guides; means to move the carriage along the guides thereto to transfer said templates to said return station, and a common template return path extending between said return station and said sorting means adjacent the entry ends of the feed path.

8. Apparatus according to claim 5 wherein said second unloading bench further comprises a cover withdrawing unit including at least two arms mounted for reciprocal movement towards and away from the second unloading bench into engagement with and to effect removal of a cover from the second unloading bench after removal of the template from the cover.

9. An apparatus for the semi-automatic manufacture of sheath-form cover for mattresses including a first series of work stations arranged sequentially to provide a first workpiece feed path having workpiece entry and exit ends comprising:

a first loading bench at the entry end for receiving a mattress template and the workpiece comprising an annular band for the formation of the side of the mattress carcass and one of two main fronts of the mattress carcass;

a first beader adjacent said loading bench, for beading said annular band to said one main front of the cover along perimetrical edges thereof;

first transfer means operable to extend between the first loading bench and the first beader for transferring said carcass from said loading bench to said first beader;

a first unloading bench and a second loading bench adjacent the first unloading bench and an overturning device connected between said first unloading bench and said second loading bench, said overturning device having two sets of arms operable to engage respective opposite sides of the carcass and operable to remove the carcass from said first unloading bench overturn and deposit the carcass in overturned condition on said second loading bench;

second transfer means operable to extend between the first beader and the first unloading bench for transferring said carcass from said first beader to said first unloading bench;

a second beader adjacent said second loading bench;

third transfer means operable to extend between the second loading bench and the second beader for transferring said carcass from said second loading bench to said second beader;

said second beader being operable to bead a second main front to said annular band along perimetrical edges; and, a bench at the exit end of the feed path arranged to receive the mattress carcass with the cover formed thereon from the second beader;

fourth transfer means operable to extend between the second unloading bench and the second beader for transferring said template from said second beader to said second unloading bench.

* * * * *